US006704952B2

(12) United States Patent
Kurtz

(10) Patent No.: US 6,704,952 B2
(45) **Date of Patent: *Mar. 16, 2004**

(54) STORAGE LOCKER FOR A SLEEPING COT

(76) Inventor: Eugene Daniel Kurtz, 436 Colonial La., Dayton, OH (US) 45429

( * ) Notice: Subject to any disclaimer, the term of this patent is extended or adjusted under 35 U.S.C. 154(b) by 0 days.

This patent is subject to a terminal disclaimer.

(21) Appl. No.: 10/081,224

(22) Filed: Feb. 22, 2002

(65) Prior Publication Data

US 2003/0159214 A1 Aug. 28, 2003

(51) Int. Cl.[7] ..... A47C 19/22; A47C 17/64

(52) U.S. Cl. ..... 5/308; 5/503.1; 5/658; 5/110; 312/237; 312/245

(58) Field of Search ..... 5/308, 503.1, 658, 5/280, 110, 111; 312/237, 245

(56) References Cited

U.S. PATENT DOCUMENTS

| | | | | | |
|---|---|---|---|---|---|
| 97,981 | A | * | 12/1869 | Snead | 5/9.1 |
| 1,524,065 | A | * | 1/1925 | Timpson | 5/658 |
| 1,788,370 | A | * | 1/1931 | De Long et al. | 5/308 |
| 2,653,331 | A | * | 9/1953 | Wallen | 5/308 |
| 4,071,258 | A | | 1/1978 | Wallace | |
| 4,129,909 | A | | 12/1978 | Riehl | |
| D262,332 | S | | 12/1981 | Keller | |
| D266,806 | S | | 11/1982 | Lenger | |
| D273,260 | S | | 4/1984 | Kemp | |
| 4,811,438 | A | * | 3/1989 | Simpson | 5/308 |
| 4,831,673 | A | | 5/1989 | Winckler | |
| 5,020,173 | A | | 6/1991 | Dreyer | |
| D358,284 | S | | 5/1995 | Hill | |
| 5,651,152 | A | | 7/1997 | Richie et al. | |
| 5,758,972 | A | | 6/1998 | Mack | |
| 6,148,459 | A | | 11/2000 | Verhulst | |
| 6,173,463 | B1 | | 1/2001 | Callahan | |
| 6,233,765 | B1 | | 5/2001 | Verhulst | |
| 6,347,419 | B1 | | 2/2002 | Kurtz | |

* cited by examiner

*Primary Examiner*—Michael F. Trettel

(57) ABSTRACT

A storage locker for a sleeping cot (L) comprises a rigid container (90) of predetermined height, length, width, and cross-sectional shape, with a top (91), a bottom (92), a front (93), a back (94), a right end (95), a left end (116) and a recessed handle assembly (104). Vertical partitions (117, 119, and 120), and horizontal partitions (124, 126, and 128) within container (90) bound drawers (106), open-face compartments (108), and closed-faced compartments (118 and 121) fronted by access doors (110). Drawers (106) and doors (110) are locked closed by conventional cam locks (114). Container end apertures (96) facilitate optional attachment of prior-art foldable beverage container holder(s) (172) using various conventional fasteners including variable depth push fasteners (180). And apertures (100 and 101) in top 91 of container 90 facilitate its demountable attachment to a variety of sleeping cots (C) using conventional u-bolt assemblies (160).

27 Claims, 13 Drawing Sheets

STORAGE LOCKER FOR A SLEEPING COT

CROSS REFERENCE TO RELATED APPLICATIONS

The present invention is related to, and can be used in conjunction with or independent of, U.S. Pat. No. 6,347,419 entitled "Clamp-on Portable Storage Endboard for a Sleeping Cot" to present applicant.

BACKGROUND

1. Field of the Invention

This invention relates to storage devices, specifically to such a device designed for use with and attached to a sleeping cot or portable bed with a frame. Henceforth both will be referred to simply as a "sleeping cot" or "cot."

2. Description of Prior Art

At home or other permanent facility, storage of articles within easy reach of a sleeping bed is an important aspect of daily life many people take for granted. For obvious reasons, most people prefer to have ready access to articles such as eyeglasses, flashlights, wallets, beverages, medicines, books, magazines, clocks, lights, radios, jewelry, keys, telephones, pagers, small personal defense weapons, and a variety of other articles while in bed. Articles of furniture such as nightstands or storage bed headboards usually provide bedside storage of such articles in the home or other permanent facility. Because they are more closely associated with the concept of the present invention, examples of prior-art storage bed headboards follow:

Kemp, III, et al., U.S. Pat, No. D273,260 discloses a combined headboard and hutch unit Lenger, Jr., U.S. Pat. No. D266,806 discloses a bed headboard or similar article Keller, U.S. Pat. No. D262,332 discloses a headboard Alternative methods of bedside storage are also found in the prior art. The following patents are representative:

Mack, et al., U.S. Pat. No. 5,758,972 discloses an assisted sundries caddy bed based holding system Ritchie, et al. U.S. Pat. No. 5,651,152 discloses a storage organizer for hospital bed Dreyer Jr. U.S. Pat. No. 5,020,173 discloses a bedstead storage box Winckler U.S. Pat. No. 4,831,673 discloses an apparatus for holding articles to a bed Hill U.S. Pat. No. D358,284 discloses a bed storage compartment Riehl U.S. Pat. No. 4,129,909 discloses abed storage article Wallace U.S. Pat. No. 4,071,258 discloses a mobile underbed storage container These devices may fulfill their respective objectives of bedside storage of articles in a bed-based sleeping environment such as that found in most homes, lodging facilities, and medical treatment facilities. They do not however, address a similar need in a cot-based sleeping environment such as that found where people are temporarily quartered under field conditions. In environments like this, bedside storage takes on even greater importance.

In an environment where people are quartered under field conditions such as hunting, fishing, camping, military bivouac, or temporary emergency sheltering, personal comfort issues figure prominently in the overall quality of the experience. Important among these issues are sleeping conditions and personal storage space immediately adjacent the sleeping area. Typically, such environments are characterized by cramped sleeping quarters inside a shelter such as a tent, cabin, or crowded emergency shelter facility where sleeping conditions are marginal and personal space is extremely limited.

To improve sleeping conditions in such environments many private individuals, emergency management authorities, and the military have taken to employing sleeping cots, representative of which is the general type shown in prior-art FIG. 5 of the drawings annexed herein. Although made of lightweight materials such as aluminum, wood, and composite materials, these cots are sturdy enough to support most adults and break down into compact packages for easy transport and storage making them ideally suited for the aforementioned applications.

A beneficial by-product of the use of these cots is the area directly beneath the cot itself, henceforth "underspace," which provides a relatively large amount of space suitable for storing many miscellaneous articles such as luggage and articles of clothing. However, this underspace does not lend itself to the storage of certain types of articles, such as those that are fragile, valuable, and which, especially in a cot-based sleeping environment under field conditions, must be kept readily accessible. Among others, these articles may include eyeglasses, flashlights, wallets, money clips, beverages, medicines, toiletries, books, magazines, clocks, lights, radios, jewelry, keys, cellular phones, cameras, pagers, and, in some cases, small personal defense weapons.

Few examples of devices specifically designed to provide storage of articles on a sleeping cot are known in the prior art. U.S. Pat. Nos. 6,148,459 and 6,233,765 both entitled "Organizer" to Verhulst disclose flexible fabric organizers for draping over the side of a cot and provide for storage of articles through the use of pouches, pockets, shelves, sleeves, and beverage containers. Although capable of storing certain articles on cots, these organizers do not lend themselves to storage of fragile or valuable articles because they store articles in either an exposed or unsecured manner in fabric or fabric mesh pockets. Stored articles can thus be easily stolen or damaged by accidental impact with people or objects moving or being moved about cramped sleeping quarters. Also, the devices themselves may interfere with the fluid mounting and dismounting of the cot's sleeping surface. Most importantly however, their low-slung hanging position along the entire length of the cot renders the cot's valuable underspace storage area virtually inaccessible from the side of the cot on which the organizers hang. This may necessitate positioning the cot away from the wall of a tent, where cots are normally located, to facilitate access to its underspace from the side opposite that on which the organizer is hung. This would further reduce the already limited overall space found in most camping, bivouac, and sheltering situations.

Another example of prior art is U.S. Pat. No. 6,173,463 entitled "Cot Accessory" to Callahan. This device comprises two vertical poles that are attached to opposite corners of one end of a sleeping cot by hook and loop straps. The upper ends of the vertical poles rise high above the cot and are connected and stabilized by a horizontal pole. Hooks spaced intermittently on the vertical poles allow for storage by hanging of slinged rifles, backpacks, articles of clothing, and other hangable accoutrements. This device also does not lend itself to storage of certain articles because it is limited by design to storing only those articles that may be hung on a hook in an exposed position where they can be easily stolen or damaged. Moreover, because of its height, use of this device is limited to areas with considerable headroom thereby precluding its use within smaller and sharply sloping shelters such as many camping tents. Use of this device therefore may necessitate positioning the cot away from the wall of a tent, where cots are normally located, to accommodate its additional height. This would further reduce the already limited overall space found in most camping, bivouac, and sheltering situations.

The utility of these devices is further limited in that they can function as storage devices only in a static state and must first be emptied of articles before they can be moved. They can not be used to transport articles to and from a cot-based sleeping environment and therefore lack true functional portability.

Another example of devices designed to provide storage of articles on a sleeping cot is U.S. Pat. No. 6,347,419 entitled "Clamp-On Portable Storage Endboard for a Sleeping Cot" to present applicant. Although the endboard provides storage of articles on a sleeping cot, it differs from the present invention in certain aspects which may render it undesirable under certain circumstances. First, the endboard is mounted atop the cot vice underneath it as is the present invention and therefore occupies a small portion of the cot's sleeping surface. As a result, use of the endboard in its preferred embodiment as a storage headboard may cause the feet of a very tall occupant to hang over the opposite end of the cot. To prevent this, the amount of sleeping surface taken up by the endboard must be minimized necessitating a relatively narrow width. This restricts the number and size of articles that may be stored therein. And although the endboard has a low profile, it is still somewhat exposed in its position atop a sleeping cot. It is therefore subject to damage by collision with people or objects moving or being moved about in typically cramped sleeping quarters such as tents, cabins, and crowded emergency shelters.

These devices evidence the need for one that will protectively store on a sleeping cot articles that are fragile, valuable, and of potentially immediate need in a cot-based sleeping environment. And do so without reducing the overall space within a shelter and without hampering access to the cot's sleeping surface or its underspace storage area.

SUMMARY

In accordance with a preferred embodiment of the present invention, a storage locker for a sleeping cot comprises a rigid container of predetermined height, length, width, and cross-sectional shape, with a top, a bottom, a front, a back, a right end, and a left end. A recessed handle assembly of conventional design is centrally disposed to its top. Vertical and horizontal partitions within the container bound storage drawers and both open-face and closed-face storage compartments. Low retaining walls front the open-face storage compartments and access doors front the closed-face storage compartments. Drawers and access doors are locked closed by conventional cam-locks. Apertures disposed to each end of the container facilitate optional attachment of a variety of prior-art foldable beverage container holders through the use of a variety of prior-art fasteners to include variable length push fasteners. Apertures and housings in the top of the container facilitate its demountable attachment to a variety of sleeping cots through the use of conventional u-bolt assemblies. The u-bolt assemblies clamp the container to the frame of the sleeping cot such that it cannot be removed once the storage compartment access doors are closed and locked thus protecting the articles stored therein from damage or theft.

Thus has been broadly outlined the more important features of the storage locker of the present invention in order that the detailed description thereof that follows may be better understood and its contribution to the field better appreciated. There are other features of the locker that will be described hereinafter and which will form the subject matter of the claims appended hereto. Thus before explaining the preferred embodiment of the locker in detail, it is to be understood that it is not limited in its application to the details of its construction or arrangements of its components set forth in the following description or illustrated in the drawings. The locker is capable of other embodiments and of being practiced and carried out in various ways.

Also, it is to be understood that the phraseology and terminology employed herein are for the purpose of description and should not be regarded as limiting. As such, those skilled in the art will appreciate that the conception upon which this disclosure is based may be utilized as a basis for the designing of other structures, methods, and systems for carrying out the several purposes of the locker. It is important therefore, that the claims be regarded as including such equivalent constructions in so far as they do not depart from the spirit and scope of my locker. Further, the purpose of the abstract is to enable U.S. Patent and Trademark Office personnel, engineers, practitioners in the art, and the general public, to quickly determine the essence of the technical disclosure of the application. The abstract is neither intended to define the invention or limit its scope in any way.

OBJECTS AND ADVANTAGES

Accordingly, besides those described above, several additional objects and advantages of my locker are:

(a) to provide a storage locker that will store articles that are fragile, valuable, or of potentially immediate need in cot-based sleeping environments such as hunting, fishing, camping, military bivouac, and emergency sheltering; and (b) to provide a storage locker that can be quickly, easily, and securely mounted to a cot through the use of conventional u-bolt assemblies; and (c) to provide a storage locker mounted to a cot such that it cannot be removed when its storage compartment access doors are closed and locked without damage to the locker or the cot; and (d) to provide a storage locker that will allow access to the storage space beneath a cot; and (e) to provide a storage locker that will not impede fluid access to the sleeping surface of a cot; and (f) to provide a storage locker that stores articles while both attached to a cot or in transit thereto or therefrom; and (g) to provide a storage locker that will optionally receive for attachment a variety of prior-art foldable beverage container holders through the use of a variety of prior-art fasteners to include variable depth push fasteners; and (h) to provide a storage locker that in an alternative embodiment serves as a console to house built-in amenities that include but are not limited to electronic appliances such as a light, a radio, and a clock; and (i) to provide a storage locker that can be attached to a variety of sleeping cots without the use of tools; and (j) to provide a storage locker that can be attached to both the side of a cot or the end of a cot.

Further objects and advantages of my locker become apparent upon review of the drawings and ensuing description.

DRAWING FIGURES

Figure 1:
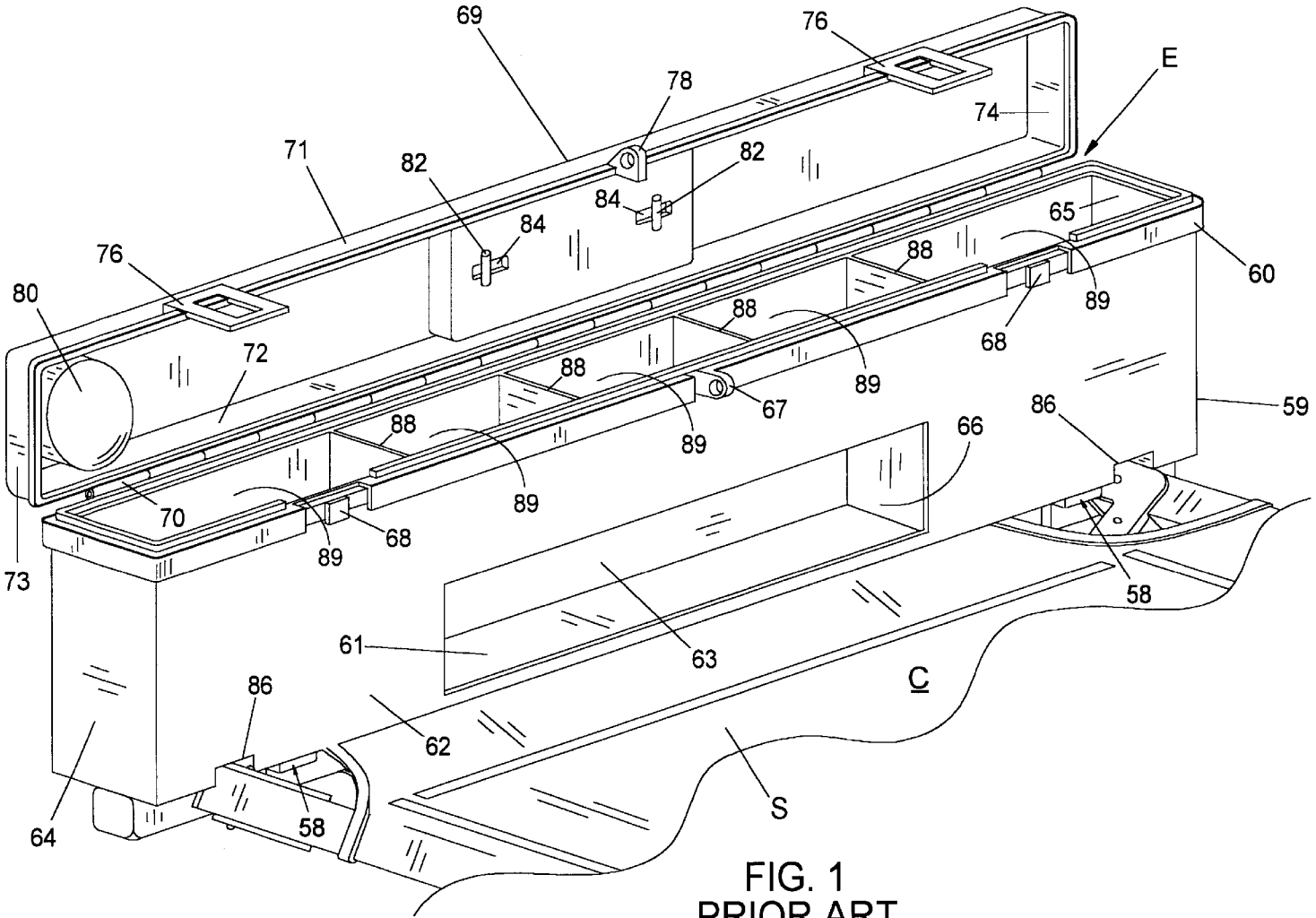
FIG. 1 PRIOR ART
FIG. 1 is a front perspective view from above of a prior-art storage endboard attached to a prior-art sleeping cot.

| Reference Letters and Numerals in Drawings | |
|---|---|
| C | aluminum or wood frame sleeping cot (Prior Art) |
| E | Clamp-on Portable Storage Endboard for a Sleeping Cot (Prior Art) |
| L1 | storage locker for a sleeping cot (Present Invention-Preferred Embodiment) |
| L2 | storage locker for a sleeping cot (Present Invention-Alternative Embodiment) |
| S | sleeping surface of sleeping cot C |
| U | underspace storage area of sleeping cot C |
| 58 | u-bolt mounting bracket clamp assy (Prior Art) |
| 59 | container of endboard E |
| 60 | upper annular lip of container |
| 61 | bottom of container |
| 62 | front wall of container |
| 63 | back wall of container |
| 64 | right wall of container |
| 65 | left wall of container |
| 66 | externally accessed storage compartment |
| 67 | container locking lug |
| 68 | container latching lug |
| 69 | mating lid |
| 70 | conventional hinge |
| 71 | front of lid |
| 72 | back of lid |
| 73 | right end of lid |
| 74 | left end of lid |
| 76 | lid latch |
| 78 | lid locking lug |
| 80 | recessed beverage holder |
| 82 | carrying handle lug |
| 84 | carrying handle mounting aperture |
| 86 | cot siderail clearance housing |
| 88 | vertical sidewall |
| 89 | internally accessed storage compartment |
| 90 | container of locker L1 (Present_Invention) |
| 91 | top of container |
| 92 | bottom of container |
| 93 | front of container |
| 94 | back of container |
| 95 | right end of container |
| 96 | container end aperture |
| 100 | cot-side mounting aperture |
| 101 | cot-end mounting aperture |
| 102 | cot siderail clearance housing |
| 104 | conventional recessed handle assembly |
| 106 | storage drawer |
| 107 | pull |
| 108 | open face storage compartment |
| 109 | retaining wall |
| 110 | closed-face storage compartment access door |
| 112 | knob |
| 113 | conventional hinge |
| 114 | conventional cam lock |
| 115 | inner surface of storage compartment access door |
| 116 | left end of container |
| 117 | vertical partition bounding vertically arrayed closed-face storage compartments and vertically arrayed open-face storage compartments |
| 118 | vertically arrayed small closed-face storage compartments |
| 119 | vertical partition bounding vertically arrayed open-face storage compartments and vertically arrayed storage drawers |
| 120 | vertical partition bounding vertically arrayed storage drawers and closed-face storage compartment |
| 121 | large closed-face storage compartment |
| 122 | storage drawer bay |
| 123 | front panel of storage drawer |
| 124 | horizontal partition separating vertically arrayed small closed-face storage compartments |
| 126 | horizontal partition separating vertically arrayed open face storage compartments |
| 128 | horizontal partition separating vertically-arrayed storage drawers |
| 130 | conventional ferrous metal strike plate |
| 132 | conventional magnetic holding bracket |

-continued

| Reference Letters and Numerals in Drawings | |
|---|---|
| 134 | conventional cam |
| 136 | clock |
| 137 | radio |
| 138 | miniature floodlight |
| 139 | compartment light |
| 140 | cot frame |
| 141 | cot leg |
| 142 | cot crossarm |
| 144 | cot siderail |
| 146 | center leg-support and siderail connecting bracket |
| 148 | end leg-support bracket |
| 150 | leg-connecting bracket |
| 160 | conventional u-bolt assembly |
| 162 | wingnut |
| 164 | washer |
| 170 | u-bolt |
| 172 | prior-art foldable beverage container holder |
| 174 | annular member of container holder |
| 176 | back panel of container holder |
| 178 | base plate of container holder |
| 179 | container holder mounting aperture |
| 180 | prior-art variable depth push fastener |

DESCRIPTION

PRIOR ART

FIG. 1—Storage Endboard E

In FIG. 1 a prior-art development in sleeping cot storage devices includes a Clamp-On Portable Storage Endboard for a Sleeping Cot E mounted to a sleeping cot C with a sleeping surface S by a plurality of u-bolt mounting bracket clamp assemblies 58. Endboard E comprises an open-top rigid container 59 with an upper annular lip 60, a bottom 61, a front wall 62, a back wall 63, a right wall 64, and a left wall 65. Container 59 is generally rectangular in shape with a predetermined height, length, and width. An externally accessed storage compartment 66 is centrally disposed to the lower half of container 59. A locking lug 67 is centrally disposed to upper annular lip 60 in front wall 62 of container 59. And a plurality of latching lugs 68 is disposed to predetermined positions in annular lip 60 in front wall 62 of container 59. A mating lid 69 is pivotally connected to container 59 by a conventional hinge 70 and has a front 71, a back 72, a right end 73, and a left end 74. A plurality of latches 76 is disposed to predetermined positions at front 71 of lid 69, and a locking lug 78 is centrally disposed to front 71 of lid 69. A recessed beverage holder 80 is disposed to a predetermined position on lid 69. A carrying handle lug 82 is attached to each end of a pliable carrying handle (not shown) disposed through a plurality of carrying handle mounting apertures 84 in lid 69. A plurality of cot siderail clearance housings 86 is disposed to predetermined positions in bottom 61 of container 59. A plurality of vertical sidewalls 88 within container 59 bounds a plurality of recessed, internally accessed storage compartments 89. Endboard E differs from the present invention in certain aspects that may render its use undesirable under certain circumstances. This drawing shows that endboard E is mounted atop cot C and therefore occupies a small portion of sleeping surface S. As a result, use of endboard E in its preferred embodiment as a headboard on cot C may cause the feet of a very tall occupant to extend out past the opposite end of cot C. To preclude this problem, endboard E must be relatively narrow to reduce its impact on sleeping surface S. This restricts the number and size of articles that may be stored therein. And although endboard E is designed to have a low profile, it is still somewhat exposed in its mounted position atop cot C. It is therefore subject to damage by collision with people or objects moving or being moved about in cramped sleeping quarters associated with the use of cot C such as tents, cabins, and crowded emergency shelters.

PRESENT INVENTION

Figure 2:
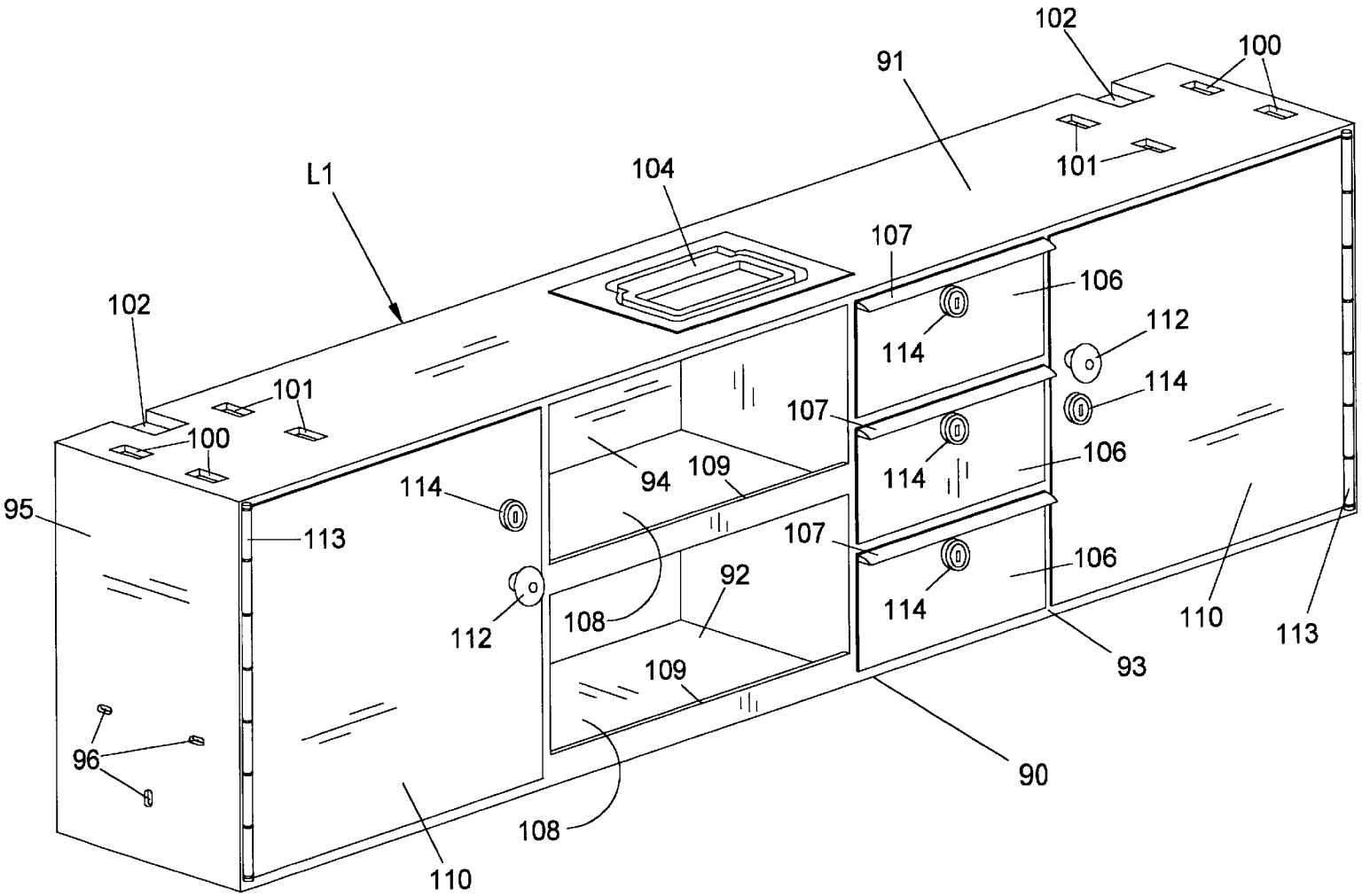
FIG. 2 is a front perspective view from above of the preferred embodiment of a storage locker for a sleeping cot of the present invention with drawers and closed-face storage compartment access doors closed.
Figure 3:
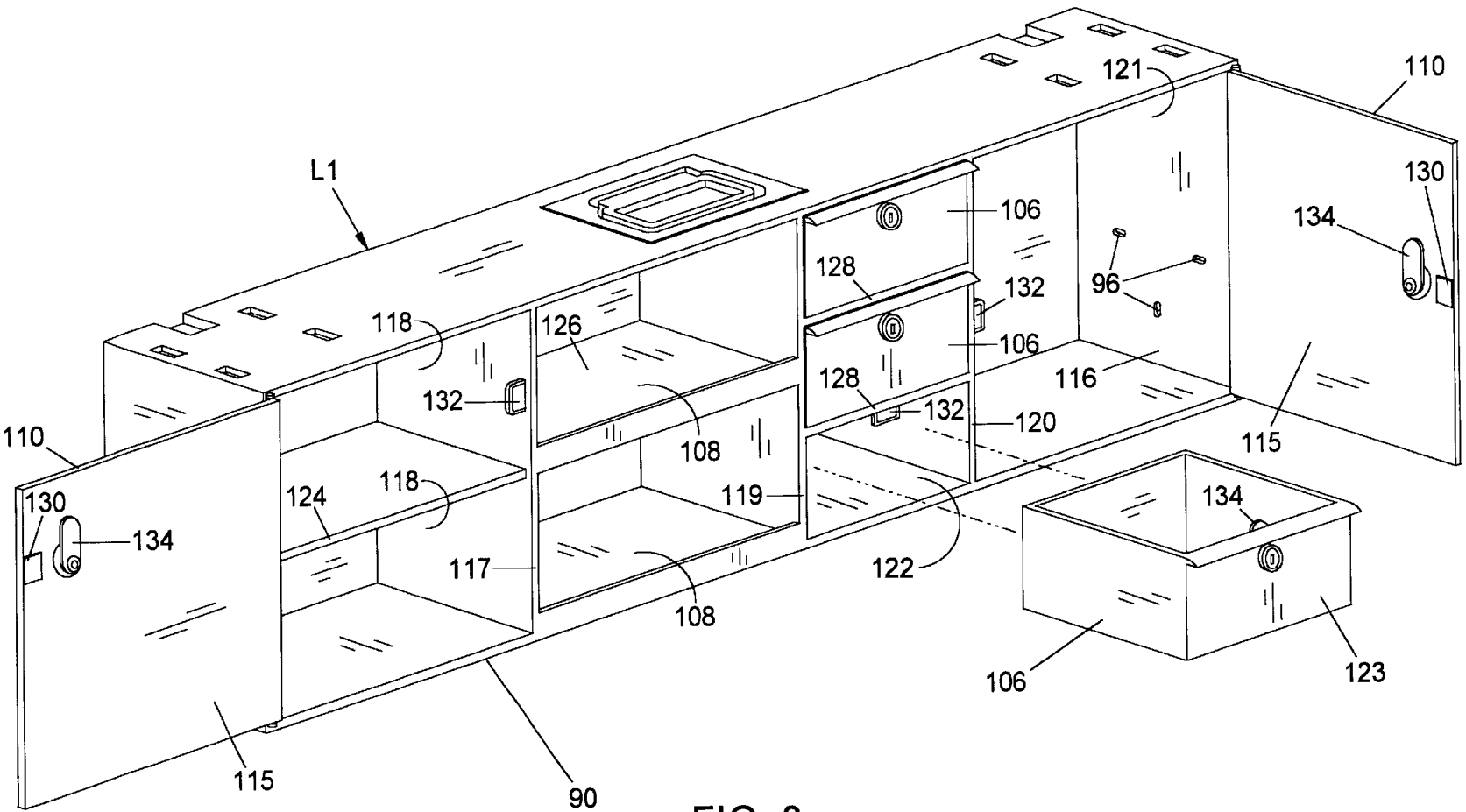
FIG. 3 is a front perspective view from above of the preferred embodiment of the storage locker with a drawer and storage compartment access doors open showing interior configuration of storage compartments and drawer bay.

FIGS. 2–3—Preferred Embodiment Storage Locker for a Sleeping Cot L1

In FIG. 2 a preferred embodiment of a new storage locker for a sleeping cot L1 of the present invention comprises a rigid container 90 of predetermined height, length, width, and cross-sectional shape. Container 90 has a top 91, a bottom 92, a front 93, a back 94, and a right end 95. A plurality of container end apertures 96 disposed to right end 95 of container 90 facilitates optional attachment of a variety of prior-art foldable beverage container holders (not shown). A plurality of cot-side mounting apertures 100, a plurality of cot-end mounting apertures 101, and a plurality of cot siderail clearance housings 102 disposed to predetermined positions on top 91 of container 90 facilitate demountable attachment of container 90 to cot C (not shown). A conventional recessed handle assembly 104 is disposed to top 91 of container 90. A plurality of vertically arrayed storage drawers 106, each with a pull 107, is disposed to left center of container 90. A plurality of vertically arrayed open-face storage compartments 108, each fronted by a low retaining wall 109, is disposed to right center of container 90. A plurality of closed-face storage compartment access doors 110, each with a knob 112, fronts a plurality of closed-face storage compartments (not shown) disposed to right and left sides of container 90. Access doors 110 are pivotally attached to container 90 by a plurality of conventional hinges 113. Doors 110 and drawers 106 are locked closed by a plurality of conventional cam locks 114.

In FIG. 3 open storage compartment access doors 110 of locker L1 reveal a plurality of access door inner surfaces 115, and a left end 116 of container 90. Container end apertures 96 disposed to left end 116 of container 90 facilitate optional attachment of a variety of prior-art foldable beverage container holders (not shown). A vertical partition 117 bounds a plurality of vertically arrayed small closed-face storage compartments 118 on right side of container 90 and vertically arrayed open-face storage compartments 108 at right center of container 90. A vertical partition 119 bounds vertically arrayed open-face storage compartments 108 and vertically arrayed storage drawers 106 at left center of container 90. And a vertical partition 120 bounds vertically arrayed storage drawers 106 and a large closed-face storage compartment 121 on left side of container 90. Dislocated lower drawer 106 reveals a storage drawer bay 122 (one of three, others not shown). Lower drawer 106 includes a front panel 123 with an inner surface (not shown) (other drawers correspond). A horizontal partition 124 separates vertically arrayed small closed-face storage compartments 118. A horizontal partition 126 separates vertically arrayed open-face storage compartments 108. And a plurality of horizontal partitions 128 separates vertically arrayed storage drawers 106. A plurality of conventional ferrous metal strike plates 130 is disposed to predetermined positions on inner surfaces 115 of access doors 110 and inner surface (not shown) of front panel 123 of dislocated lower storage drawer 106 (other drawers correspond). Strike plates 130 combine with a plurality of conventional magnetic holding brackets 132 disposed to correlating positions within closed-face storage compartments 118 and 121 and within drawer storage bay 122 (other bays correspond) to hold access doors 110 and storage drawers 106 closed respectively. Brackets 132 also serve to trap a plurality of conventional cams 134, which, upon the turn of a key (not shown), rotate into position behind brackets 132. Trapping of cams 134 behind brackets 132 effectively locks access doors 110 and storage drawers 106 closed (cam 134 in dislocated storage drawer 106 is rotated into locked position for clarity).

Figure 4:
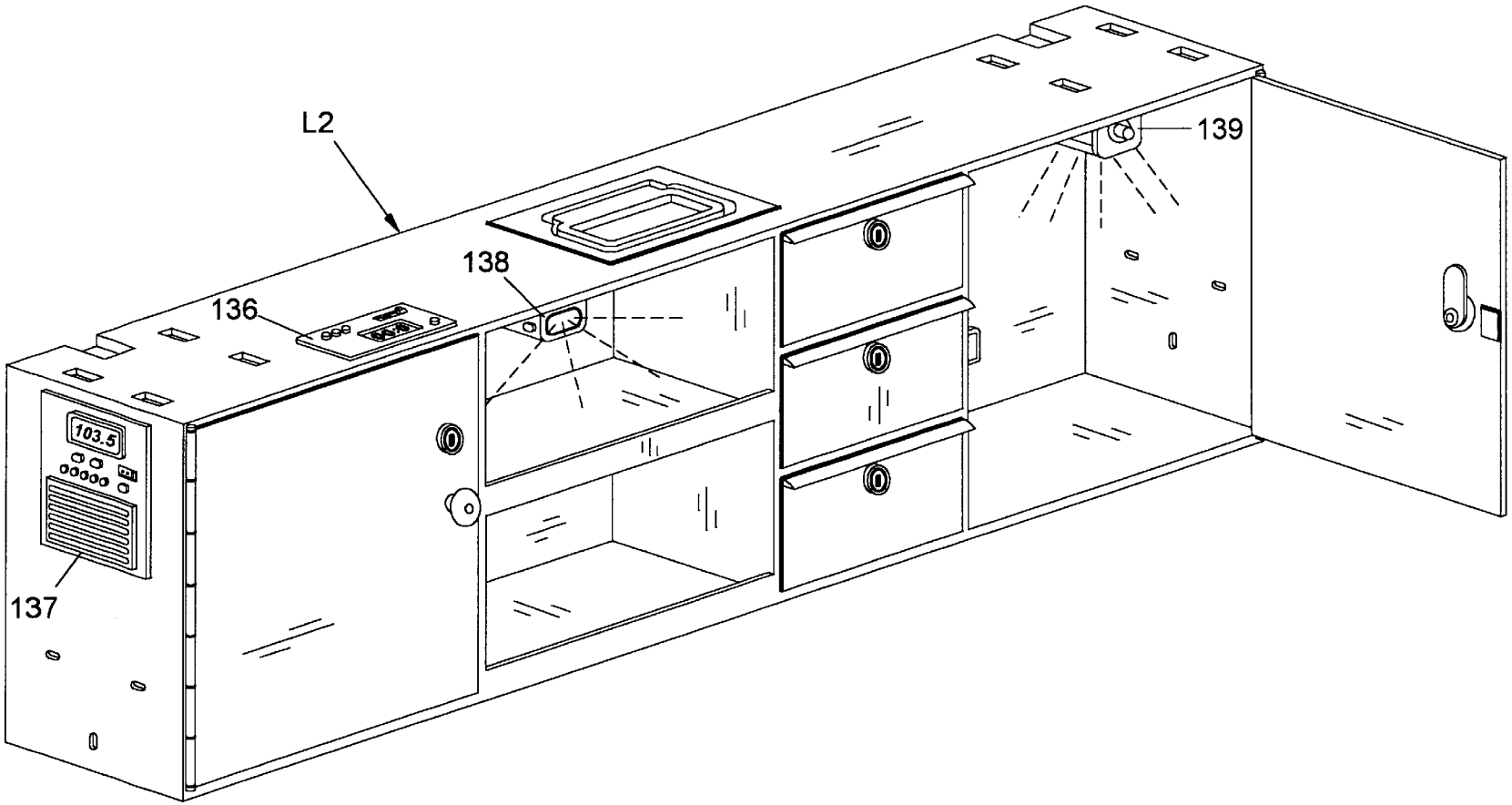
FIG. 4 is a front perspective view from above of an alternative embodiment of the storage locker for a sleeping cot that incorporates all the features of the preferred embodiment locker plus a clock, a radio, and lights.

FIG. 4—Alternative Embodiment Locker L2

In FIG. 4 an alternative embodiment of a new storage locker for a sleeping cot L2 includes all the features depicted in FIGS. 2 and 3 plus additional features. These additional features are disposed to predetermined positions on locker L2 and include a clock 136, a radio 137, a miniature floodlight 138, and a compartment light 139.

Figure 5:
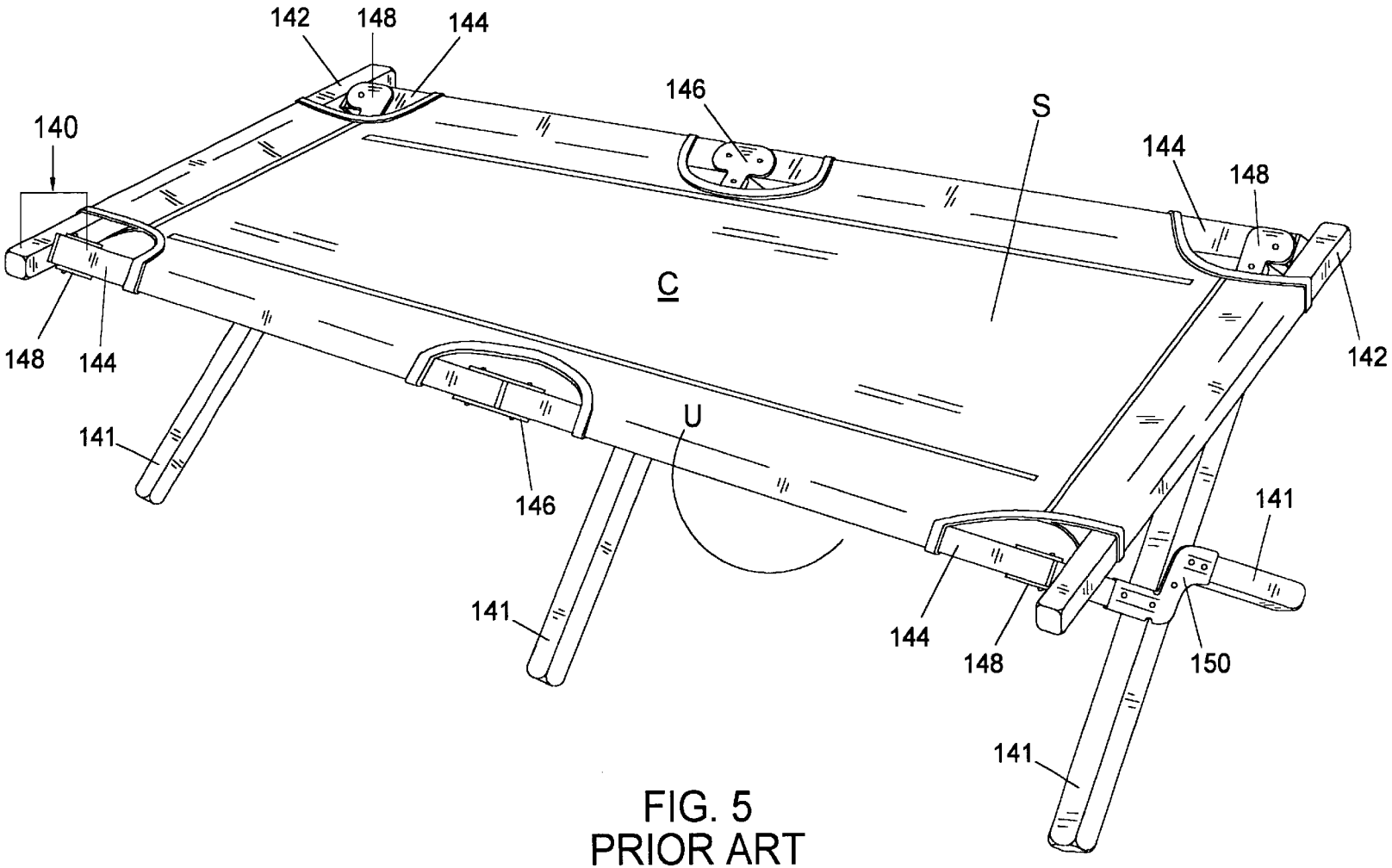
FIG. 5 PRIOR ART
FIG. 5 is a front perspective view from above depicting a prior-art sleeping cot of a general type used in illustrative mounting applications of the preferred embodiment of the storage locker.

FIGS. 5–10—Mounting of Preferred Embodiment Locker L1 to Prior Art Sleeping Cot C In FIG. 5 sleeping cot C includes sleeping surface S supported by a frame 140 which is supported by a plurality of legs 141. Frame 140 comprises a plurality of crossarms 142 and a plurality of adjoining siderails 144. Siderails 144 are joined to each other by a plurality of center leg-support and siderail connecting brackets 146. Legs 141 are attached to siderails 144 by brackets 146 or a plurality of end leg-support brackets 148. Opposing legs 141 are joined to each other by a leg-connecting bracket 150. The area beneath sleeping surface S comprises an underspace storage area U.

Figure 6:
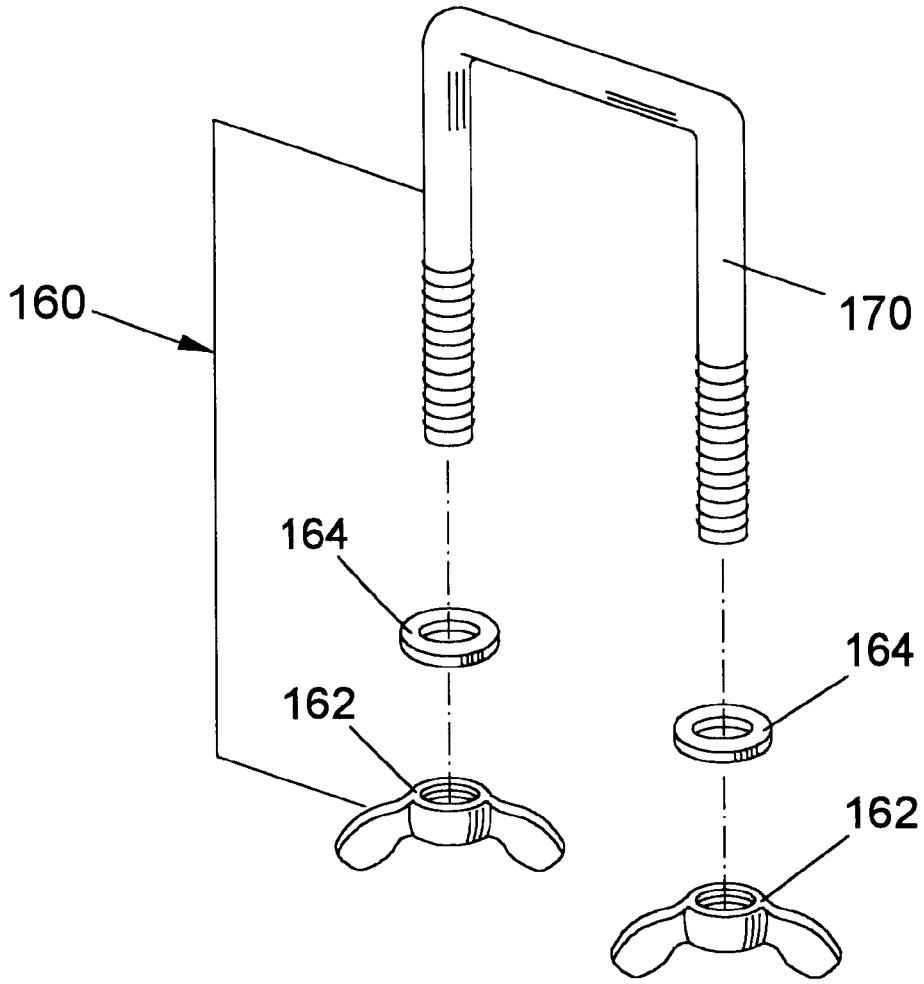
FIG. 6 is a front perspective view from above depicting a conventional u-bolt assembly of prior art design used to demountably attach the storage locker to a variety of sleeping cots.

In FIG. 6 a conventional u-bolt assembly of prior art design 160 comprises a plurality of wingnuts 162, a plurality of washers 164, and a u-bolt 170.

Figure 7:
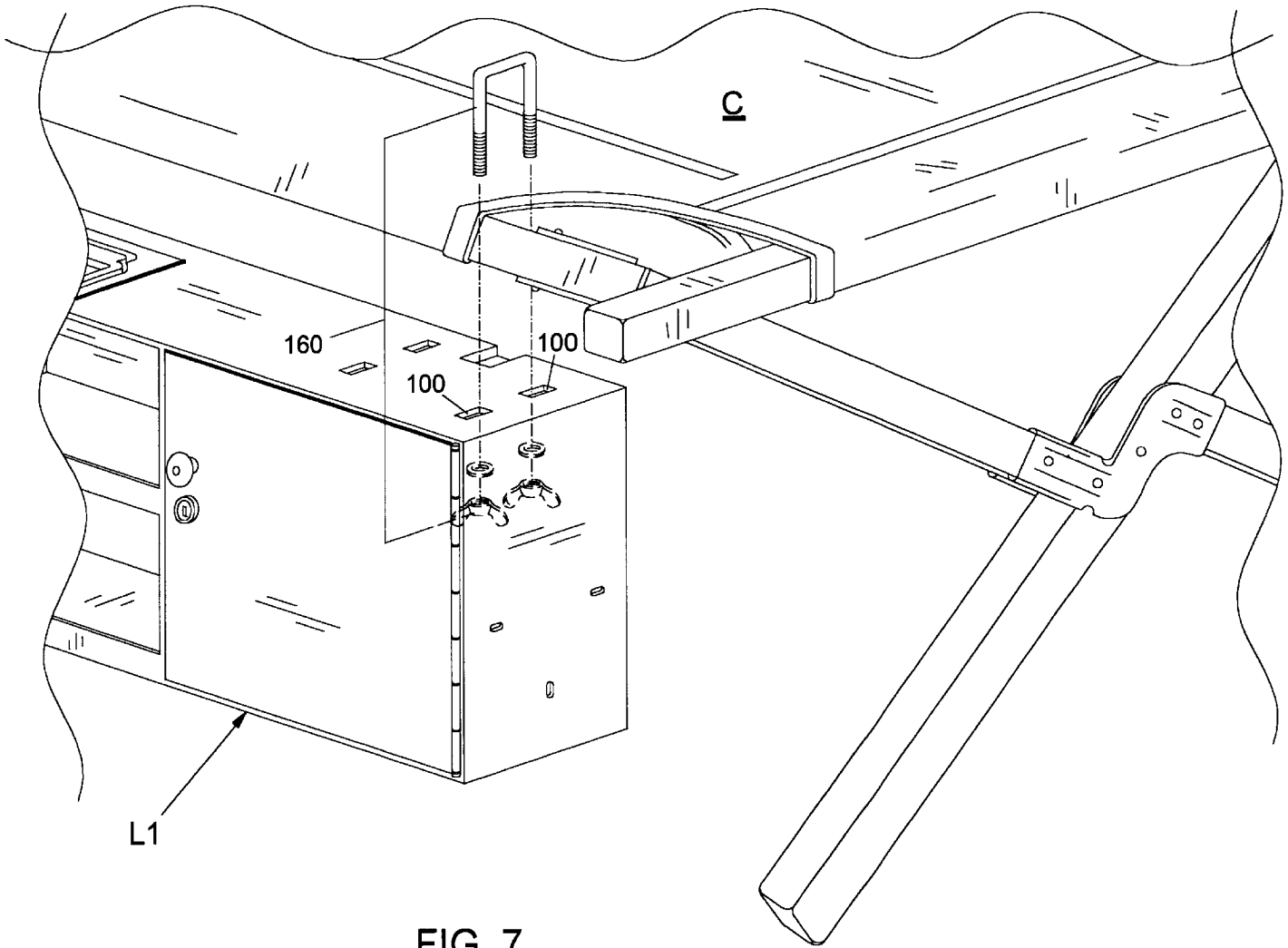
FIG. 7 is a front perspective view from above depicting the juxtaposition of the left half of the storage locker, u-bolt assembly, and one corner of a sleeping cot in their pre-attachment relationship in a preferred side-mount application.

In FIG. 7 a preferred mounting application on the side of cot C depicts left half of storage locker L1, cot-side mounting apertures 100, u-bolt assembly 160, and one corner of sleeping cot C juxtaposed in their pre-attachment relationship (relationship between remaining half of locker L1, remaining apertures 100, additional u-bolt assembly 160, and opposite corner of sleeping cot C corresponds).

Figure 8:
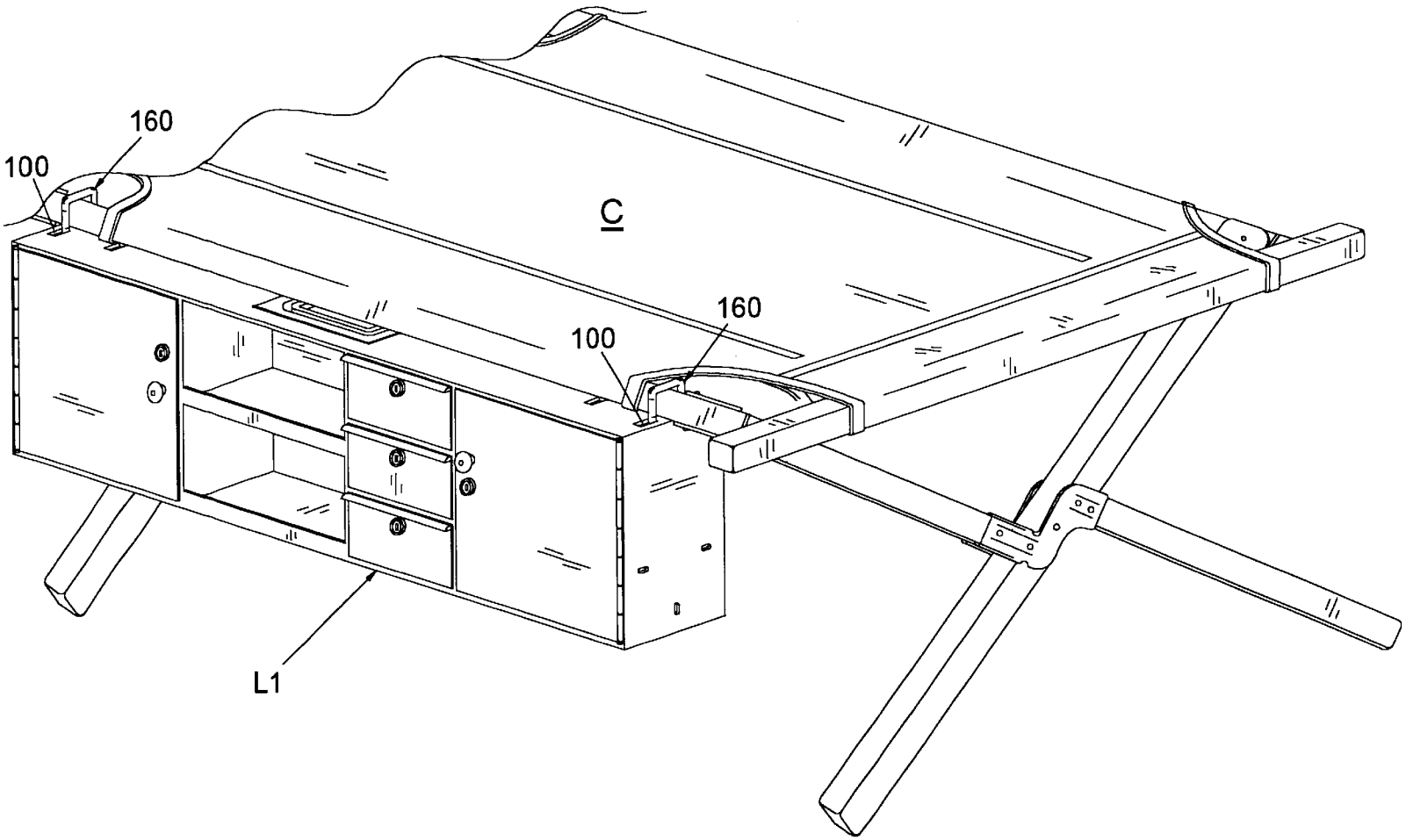
FIG. 8 is a front perspective view from above of the preferred embodiment of the storage locker in a preferred mounting application attached to the side of a sleeping cot using conventional u-bolt assemblies.

In FIG. 8 a preferred mounting application depicts storage locker L1 attached to a side of sleeping cot C using u-bolt assemblies 160 placed through cot-side mounting apertures 100.

Figure 9:
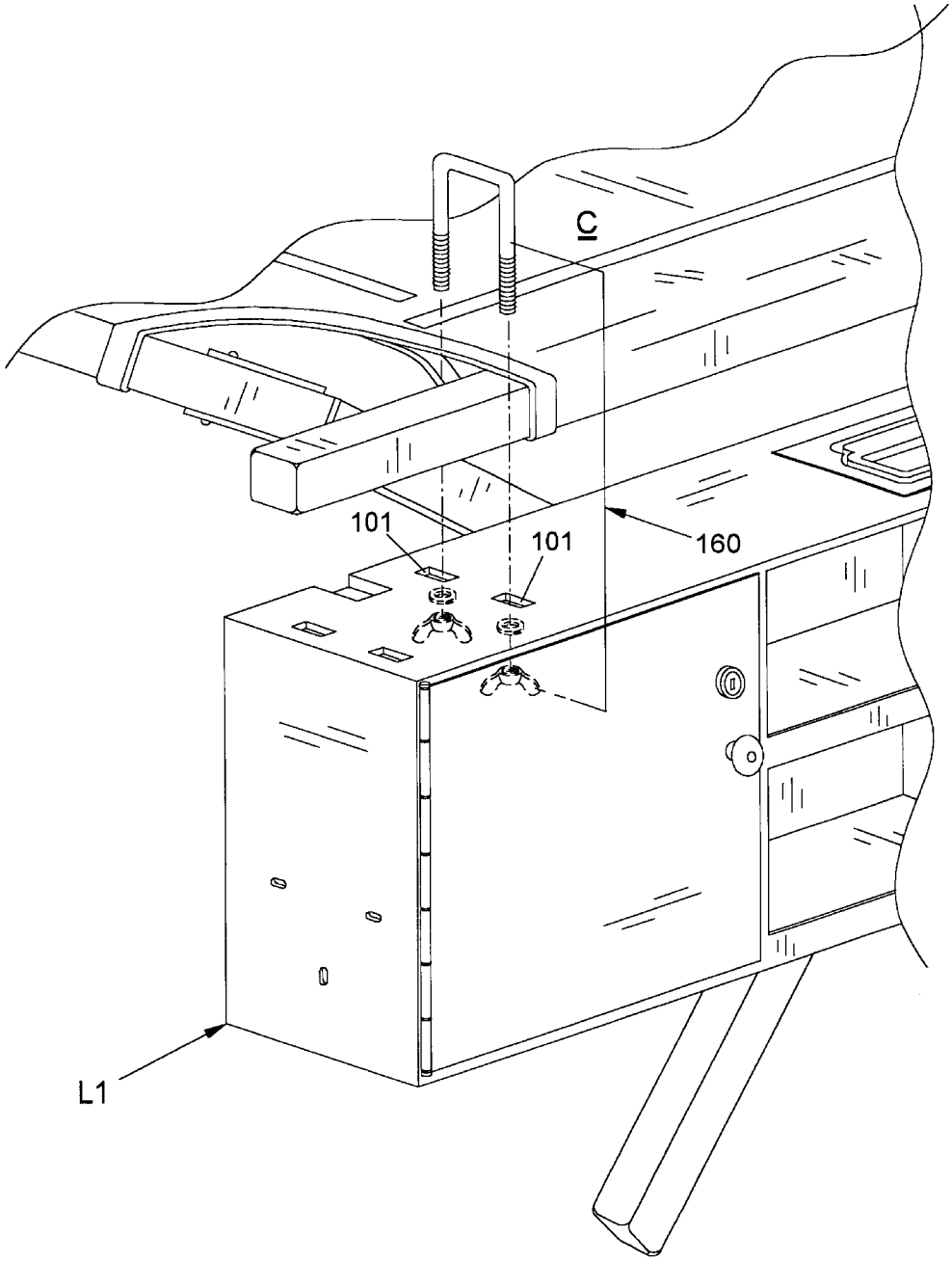
FIG. 9 is a front perspective view from above depicting the juxtaposition of the right half of the storage locker, u-bolt assembly, and one corner of a sleeping cot in their pre-attachment relationship in an alternative end-mount application.

In FIG. 9 an alternative mounting application on the end of cot C depicts the right half of storage locker L1, cot-end mounting apertures 101, u-bolt assembly 160, and one corner of sleeping cot C juxtaposed in their pre-attachment relationship (relationship between remaining half of locker L1, remaining apertures 101, additional u-bolt assembly 160, and opposite corner of sleeping cot C corresponds).

Figure 10:
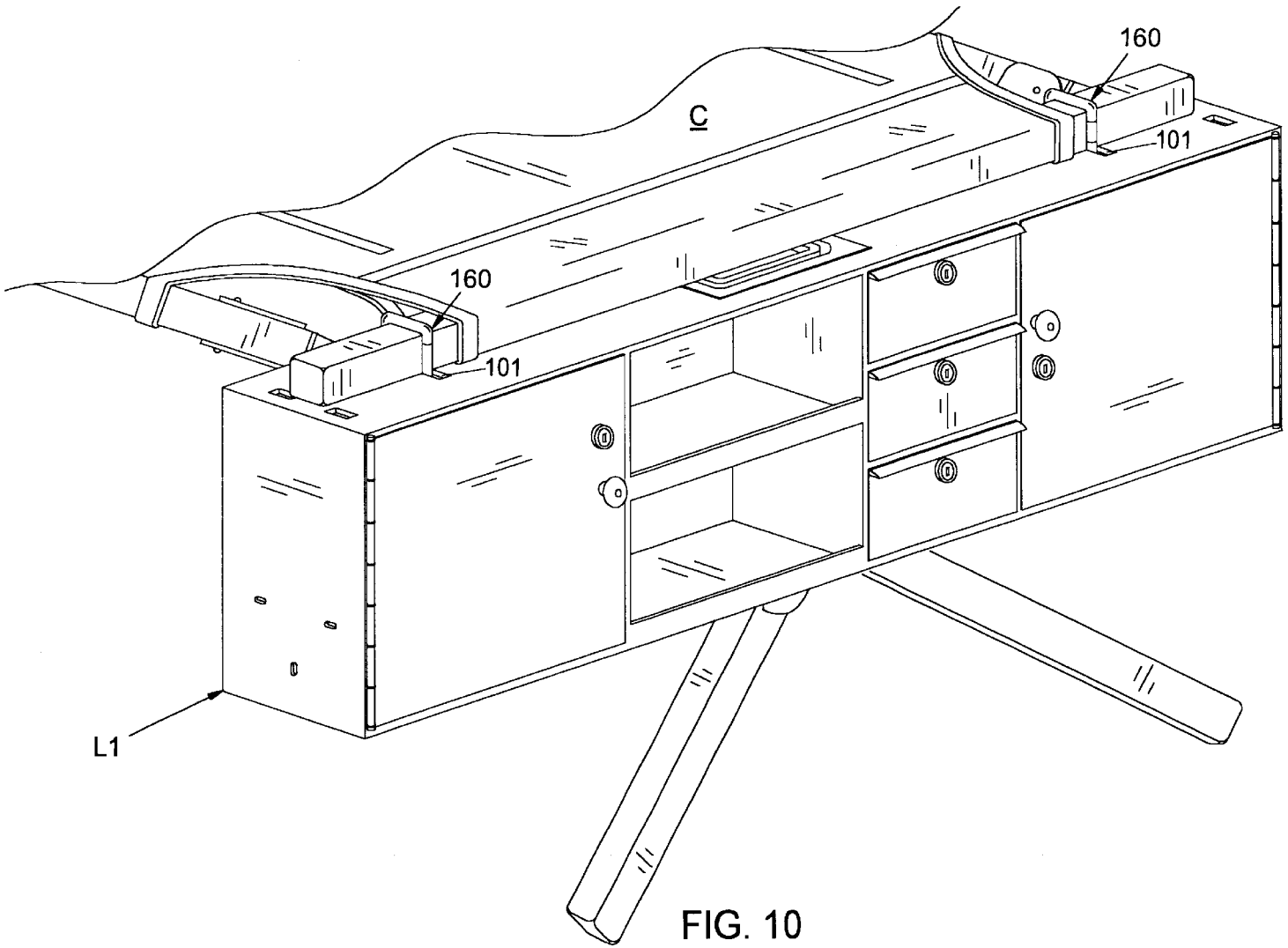
FIG. 10 is a front perspective view from above of the preferred embodiment of the storage locker in an alternative mounting application attached to the end of a sleeping cot using conventional u-bolt assemblies.

In FIG. 10 an alternative mounting application depicts storage locker L1 attached to an end of sleeping cot C using u-bolt assemblies 160 placed through cot-end mounting apertures 101.

FIGS. 11–15—Optional Mounting of Prior-Art Foldable Beverage Container Holder 172 to Storage Locker L1

Figure 11:
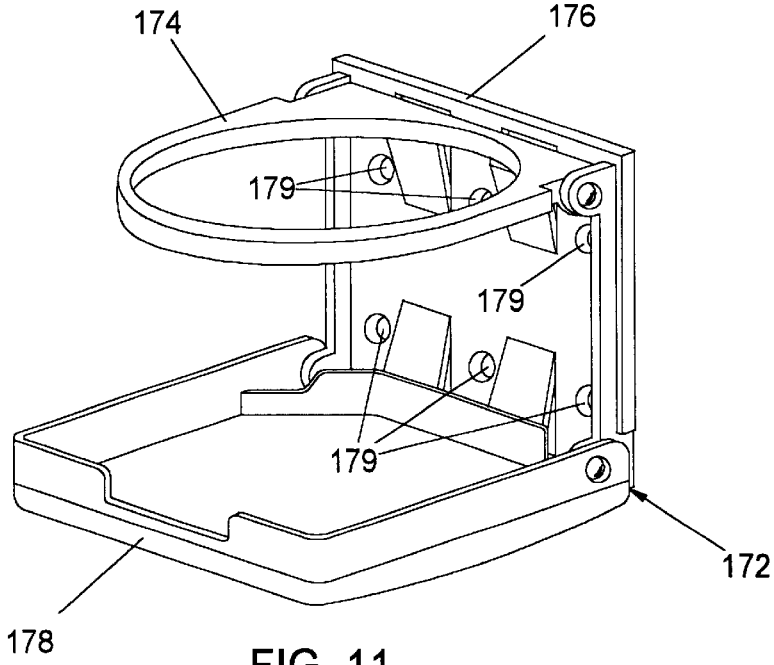
FIG. 11 PRIOR ART
FIG. 11 is a front perspective view from above depicting a prior-art foldable beverage container holder of a general type in its deployed (open) position.

In FIG. 11 a prior-art foldable beverage container holder 172 is shown in its deployed (open) position and includes an annular member 174 pivotally connected to the upper portion of a back panel 176, and a base plate 178 pivotally connected to the lower portion of back panel 176. A plurality of container holder mounting apertures 179 is disposed to predetermined positions on back panel 176 of container holder 172 to facilitate its attachment to a variety of support structures (not shown).

Figure 12:
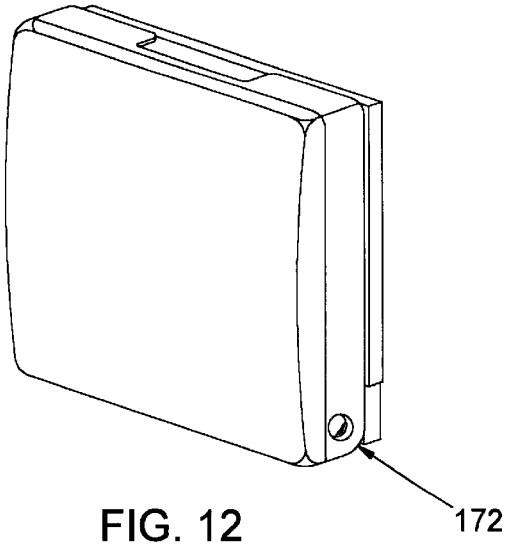
FIG. 12 PRIOR ART
FIG. 12 is a front perspective view from above depicting beverage container holder in its stowed (closed) position.

In FIG. 12 beverage container holder 172 is shown in its stowed (closed) position.

Figure 13:
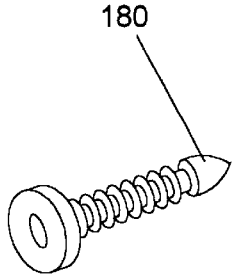
FIG. 13 PRIOR ART
FIG. 13 is a front perspective view from above of a prior-art variable depth push fastener used in an illustrative mounting application to attach beverage container holder to storage locker (fastener is not drawn to relative scale).

In FIG. 13 a prior-art variable depth push fastener 180 is depicted.

Figure 14:
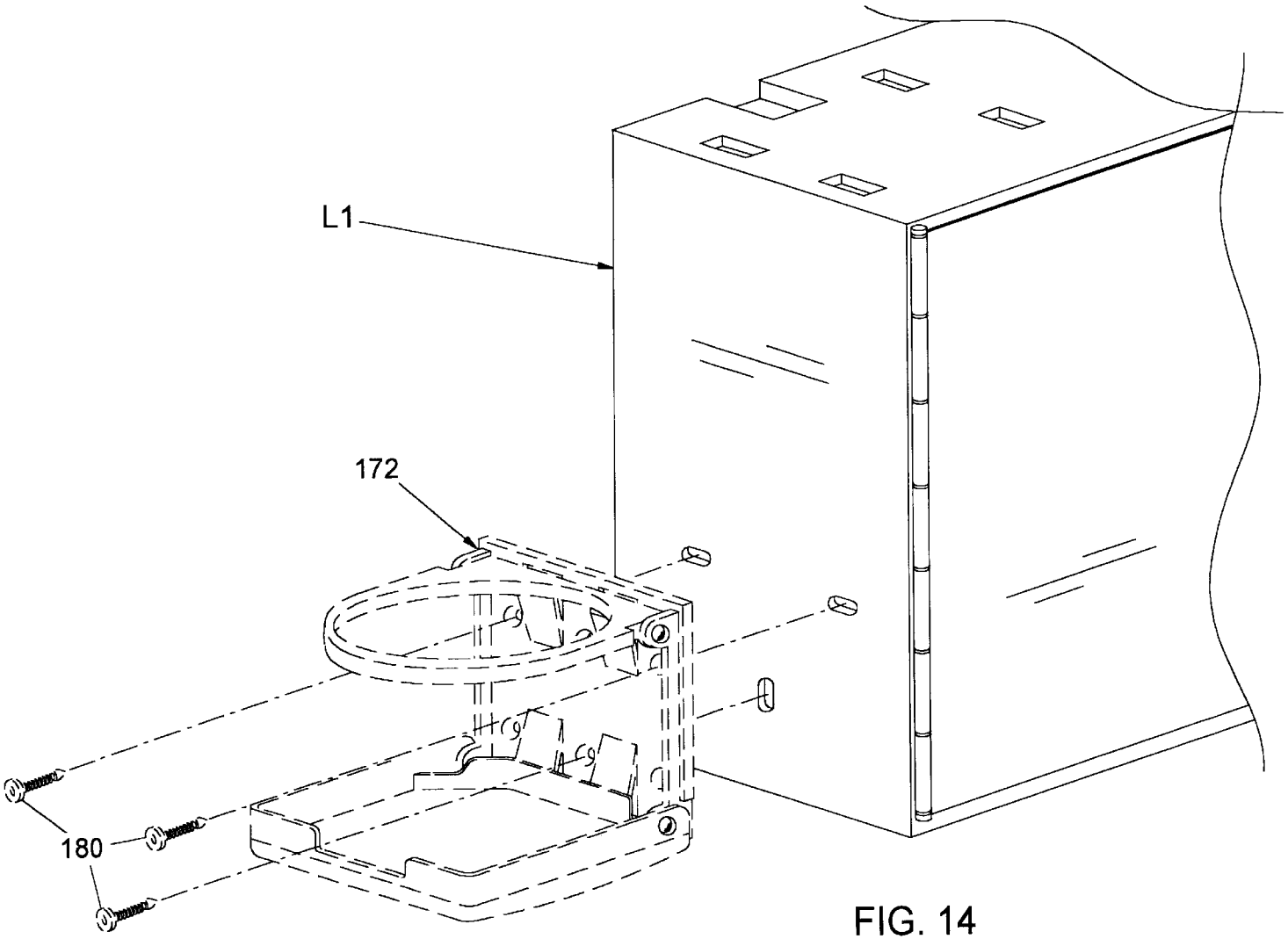
FIG. 14 is a front perspective view from above depicting the juxtaposition of beverage container holder, variable depth push fasteners, and storage locker in their pre-attachment relationship.

In FIG. 14 container holder 172, fasteners 180, and locker L1 are juxtaposed in their pre-attachment relationship.

Figure 15:
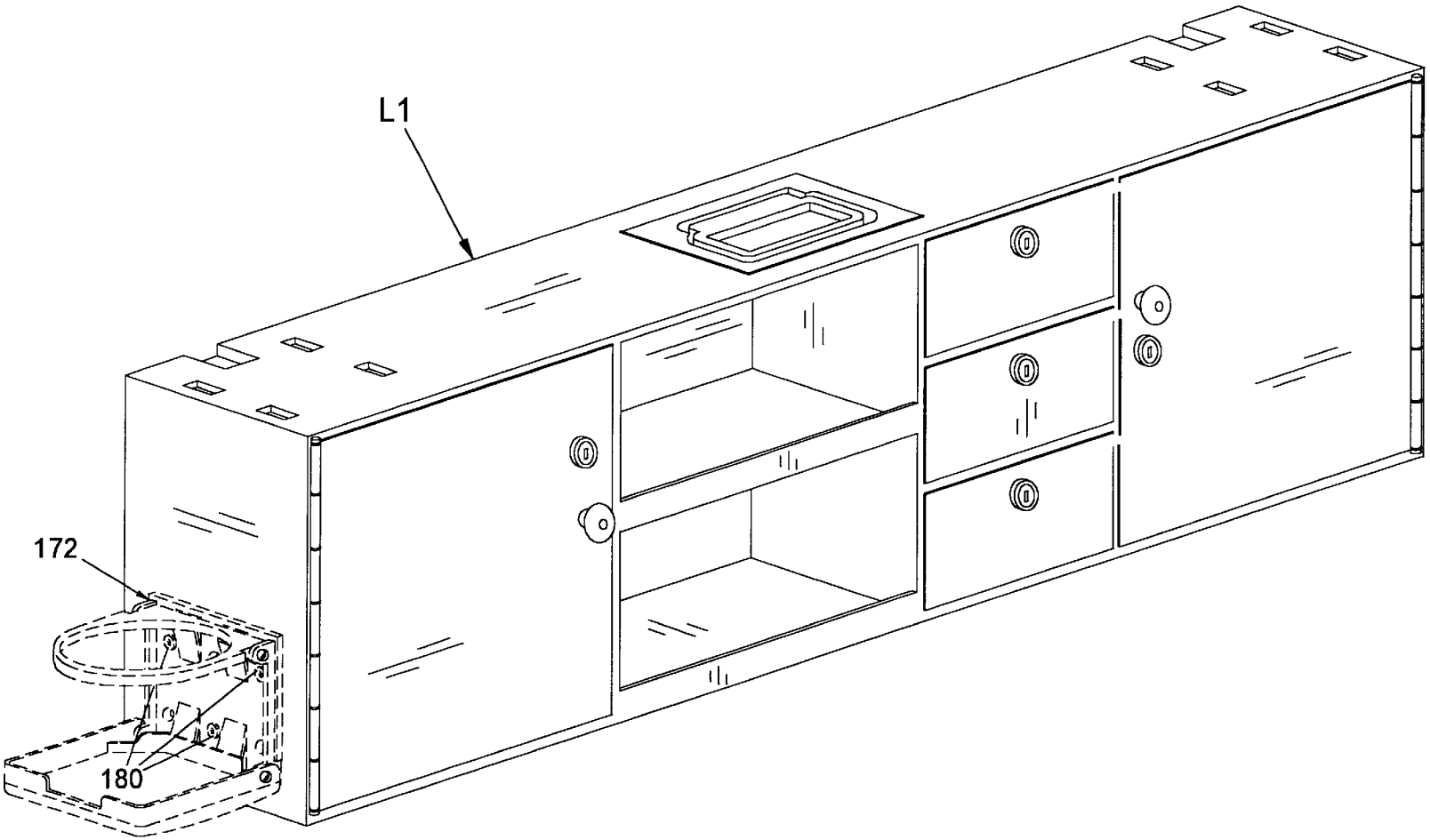
FIG. 15 is a front perspective view from above depicting the prior-art foldable beverage container holder optionally attached to storage locker using push fasteners (container holder may be attached to either end of the locker).

In FIG. 15 beverage container holder 172 is attached to locker L1 using fasteners 180.

Advantages

From the description above a number of advantages of my storage locker become evident:

(a) Proximate and protective storage is provided for the myriad fragile and/or valuable articles key to the welfare of personnel subsisting under field conditions in cot-based sleeping environments such as hunting, fishing, camping, military bivouac, and short or long term temporary emergency sheltering.

(b) Use of the locker on a cot allows articles to be stored close-at-hand for quick and easy retrieval. This is especially important in a cot-based sleeping environment where power for electric lights is typically unavailable or not readily accessible. For example when used while camping, eyeglasses and flashlight stored in the locker's open-face storage compartments can be quickly retrieved in the dark. This can facilitate a trip to the latrine or investigation of the seemingly unending string of things that go "bump" in the night while camping.

(c) Unlike other attempts at providing storage of articles on a cot, the locker's interior storage and lockability features provide a measure of security from damage or theft of articles stored therein. For when the locker is secured to the sleeping cot and its storage compartment access doors are locked closed, the u-bolt assemblies cannot be loosened or removed from the locker without structural damage to either the locker or the cot.

(d) Also unlike other prior-art attempts at providing storage of articles on a cot, the locker, because it is mounted beneath the sleeping surface of the cot, will not interfere with fluid access to the sleeping surface. Nor will the locker completely block access to a cot's underspace storage area. For in a preferred mounting application it occupies only one half of one side of the cot, leaving access to the cot's underspace from the remaining half. And in an alternative mounting application it occupies the space outboard of and perpendicular to the cot's end legs. This ability to be mounted almost anywhere on the frame of a cot gives the user much flexibility in configuring the sleeping area.

(e) Also unlike the previously mentioned "organizer" and "cot accessory" which must be emptied before they can be moved, the locker can be transported with articles secured in its locked compartments and drawers thus offering true functional portability.

(f) Also unlike other prior-art attempts at providing storage of articles on a cot, the locker is designed to optionally receive for attachment on each of its sides a variety of foldable beverage container holders of prior-art design.

(g) Also unlike prior-art attempts to provide storage of articles on a cot, the locker, in an alternative embodiment, can be used as a console to house built-in convenience and safety amenities such as electronic appliances like a clock, a radio, and flood and task lights.

Operation

In the preferred mounting application, operation entails attaching container 90 of storage locker L1 to a side of sleeping cot C using u-bolt assemblies 160 placed through cot-side mounting apertures 100 in top 91 of container 90 as follows. Take a seated position on one side of and facing cot C with your legs fully extended under cot C between its center and end legs 141. Place container 90 on your lap underneath of and parallel to cot siderail 144 with front 93 of container 90 facing you. Raise container 90 upwards into position against cot siderail 144 with cot-side mounting apertures 100 perpendicularly centered against siderail 144 in the uncovered portions of siderail 144 that lie between its joints with cot crossarm 142 and center leg-support and siderail connecting bracket 146. Hold container 90 in place with upward pressure from your legs. Working on either side of container 90, open closed-face storage compartment access door 110. With threaded end down, hold u-bolt 170 above and perpendicular to siderail 144 and lower u-bolt 170 such that its threaded ends straddle siderail 144 and pass through cot-side mounting apertures 100 in top 91 of container 90. Reach into affected closed-face storage compartment 118 or 121 and place washer 164 over threaded end of u-bolt 170 protruding downward through top 91 of container 90. Follow washer 164 with wingnut 162 and tighten loosely at this juncture. Repeat this process with remaining threaded end of u-bolt 170. With u-bolt assembly 160 loosely in place on one side of container 90, loosely install remaining assembly 160 on opposite side of container 90 in similar fashion using cot-side mounting apertures 100. With both assemblies 160 loosely fastened in place, make any final adjustments in the position of container 90 on siderail 144 and tighten all wingnuts 162 to secure container 90 to cot C. Operating instructions for the alternative mounting application (i.e., on the end of cot C) can be easily extrapolated from the above instructions using cot-end mounting apertures 101 instead of cot-side mounting apertures 100 and ensuring that the ends of cot siderails 144 align with cot siderail clearance housings 102 on top 91 of container 90. Operating instructions for the alternative embodiment storage locker L2 parallel those of the preferred embodiment locker L1.

Conclusion, Ramifications, and Scope

Accordingly, the reader will see that the storage locker of the present invention can be used to proximately and protectively store articles on a sleeping cot. Such storage is an extremely important quality-of-life factor for people quartered under field conditions in cot-based sleeping environments such as hunting, fishing, camping, military bivouac, or temporary emergency sheltering. For typically under these conditions storage space is extremely limited and secure storage space even moreso. Unlike some other devices available for such duty, the locker of the present invention can safely store items that are fragile, valuable, or of potentially immediate need in such sleeping environments. These items include, but are not limited to, eyeglasses, flashlights, wallets, money clips, beverages, medicines, toiletries, books, magazines, clocks, lights, radios, jewelry, keys, cellular phones, cameras, pagers, and, in some cases, small personal defense weapons. These items are protected from damage because they are stored inside the locker vice outside as with other devices. And they are protected from theft because the locker is mounted on the cot in such a manner that, when its storage compartment access doors are locked, it cannot be removed without obvious damage to either the locker or the cot.

Although designed for use in cot-based sleeping environments under field conditions, the locker has domestic applications also. For the conventional u-bolt assemblies allow the locker to be attached to a wide variety of support structures. For example, the locker could be attached to the frame of a standard bed and used in homes, hotels, military barracks, college dormitories, correctional facilities, and the like to store a user's personal articles. Further, the locker could be attached to the frame of a baby crib and used to store baby care products. The wide variety of potential uses for the locker of the present invention is attributable to its simplistic design, ease of use, and functional utility. The locker has additional advantages in that;

(a) it can be quickly, easily, and securely mounted to and demounted from a variety of sleeping cots through the use of simple yet effective conventional u-bolt assemblies; and (b) it can be mounted to both the side of a cot or the end of a cot; and (c) it can be mounted to and demounted from these cots without the use of tools; and (d) it provides both stationary and portable storage of articles in that it can store articles while both mounted on a cot or in transit thereto and therefrom; and (e) it provides storage for articles of different sizes and shapes in its differently sized and shaped storage compartments; and (f) it is designed to optionally receive for attachment a variety of foldable beverage container holders of prior-art design at either or both of its ends thereby affording its user wider options in the positioning of the cot within the confines of the shelter; and (g) in an alternative embodiment it serves as a console to house built-in safety and convenience items such as electronic appliances like a radio and a clock.

Although the description above contains much specificity, it should not be construed as limiting the scope of the locker but merely providing illustrations of some of the presently preferred embodiments of the locker. For example, (a) the locker can be rendered in a variety of sizes to accommodate cots of various dimensions; and (b) the locker can take other shapes such as square, semi-circular, oval, trapezoidal, triangular, etc.; and (c) the locker can be constructed of a variety of materials such as plastic, metal, or composite material and be of any color or combination thereof such as a monochromatic green or a polychromatic camouflage pattern; and (d) storage compartments can be rendered in many different configurations such as varying their type, shape, orientation, number, size, and relative location; and (e) access door and storage drawer locking mechanisms can take other forms such as conventional key-actuated drawer-type deadbolt locks when locker is privately owned, or lockable hasps which could receive a padlock or combination lock when locker is temporarily issued to an individual and must be returned for future use; and (f) the number of access doors and storage drawers equipped with locking mechanisms can vary from none to all; and (g) mounting methods can comprise devices other than u-bolts, such as straps, cables, chains, or bolts; and (h) the locker can be mounted on various locations on the cot, such as at any of four locations on the sides of the cot paralleling the sleeping surface, or at either end of the cot perpendicular to the sleeping surface; and (i) apertures can be of different shapes and sizes, placed in different locations, or dispensed with; and (j) the type of cot upon which locker may be mounted can be of various sizes with angular or tubular frames; and (k) the type of sleeping apparatus upon which the locker may be mounted can comprise apparatus other than cots, such as folding beds, rollaway beds, or any sleeping apparatus with a frame; and (l) in its alternative embodiment, the locker's clock, radio, and flood and task lights can be located in different places on or in the locker; and (m) in an alternative embodiment, the locker's concept can be combined with that of the aforementioned prior-art Clamp-On Portable Storage Endboard for a Sleeping Cot and made into a single unit embodying the utility of both; and (n) a variety of prior-art beverage container holders can be optionally attached to the locker through the use of a variety of prior-art fasteners, such as nuts and bolts or variable depth push fasteners.

(o) handle or handles can be mounted on top of the locker or at each end.

Thus the scope of the invention should be determined by the appended claims and their legal equivalents rather than by the examples given.

I claim:

1. A storage locker for a sleeping cot comprising:

(a) a rigid container of predetermined height, length, width, and cross-sectional shape, with a top, a bottom, a front, a back, a right end, and a left end, and (b) at least one partition within said container bounding a plurality of compartments, and (c) first means, including a conventional u-bolt assembly, for attaching said container to said cot, whereby said container can be demountably attached to said cot, and whereby a person occupying said cot can store a variety of articles within said container.

2. The locker of claim 1 further comprising a plurality of apertures disposed to predetermined positions in said top of said container to facilitate said first means for attaching said container to said cot.

3. The locker of claim 1 further comprising a plurality of housings disposed to predetermined positions in said top of said container to facilitate said first means for attaching said container to said cot.

4. The locker of claim 1 wherein said compartments include at least one drawer.

5. The locker of claim 4 further comprising second means for reversibly locking said drawer in a closed position.

6. The locker of claim 5 wherein said second means for reversibly locking said drawer in said closed position includes a conventional cam lock.

7. The locker of claim 1 wherein said compartments include at least one open-face compartment.

8. The locker of claim 1 wherein said compartments include at least one closed-face compartment fronted by an access door.

9. The locker of claim 7 further comprising third means for reversibly locking said access door in a closed position.

10. The locker of claim 9 wherein said third means for reversibly locking said access door in said closed position includes a conventional cam lock.

11. The locker of claim 1 furthercomprising a plurality of apertures disposed to predetermined positions on said right end and said left end of said container to facilitate optional attachment of a variety of prior-art beverage container holders.

12. The locker of claim 1 comprising a handle disposed to a predetermined position on said container.

13. In combination:

(a) a lightweight, foldable, and portable sleeping cot of conventional design with a fabric sleeping surface supported by a peripheral frame, and said frame supported by a plurality of one-piece, || (||U-shaped||) || for example, or two-piece conjoined, || (||crisscrossed and bracketed||) || for example, legs, and (b) a locker comprising a lightweight and portable container of predetermined height, length, width, and cross-sectional shape with a top, a bottom, a front, a back, a right end, and a left end, and (c) at least one partition within said container bounding a plurality of compartments, and (d) first means for attaching said container to said cot, whereby said container can be demountably attached to said cot, and whereby an individual occupying said cot can conveniently store a variety of articles in said container, and whereby said articles can remain stored in said container while said container is attached to said cot, or in transit thereto or therefrom.

14. The combination of claim 13 further comprising a plurality of apertures disposed to predetermined positions in said top of said container to facilitate said first means for attaching said container to said cot.

15. The combination of claim 13 further comprising a plurality of housings disposed to predetermined positions in said top of said container to facilitate said first means for attaching said container to said cot.

16. The combination of claim 13 wherein said compartments include at least one drawer three to ten inches deep.

17. The combination of claim 13 further comprising second means for reversibly locking said drawer in a closed position.

18. The combination of claim 13 wherein said compartments include at least one open-face compartment.

19. The combination of claim 13 wherein said compartments include at least one closed-face compartment fronted by an access door.

20. The combination of claim 19 further comprising third means for reversibly locking said access door in a closed position.

21. The combination of claim 13 further including a clock disposed to a predetermined position on said container.

22. The combination of claim 13 further including a radio disposed to a predetermined position on said container.

23. The combination of claim 13 further including a miniature floodlight disposed to a predetermined position on said container.

24. The combination of claim 13 further including a compartment light disposed to a predetermined position on said container.

25. The combination of claim 13 further comprising fourth means for optionally attaching a variety of prior-art foldable beverage container holders to said right side and said left side of said container.

26. The combination of claim 13 further including handle means by which said container can be lifted, whereby an individual can conveniently transport said container.

27. A method of storing a variety of articles on a sleeping cot comprising the steps of:

(a) providing a rigid container of predetermined height, length, width, and cross-sectional shape, with a top, a bottom, a front, a back, a right end, and a left end, and (b) providing a plurality of apertures disposed to predetermined positions in said top of said container to facilitate attachment of said container to said cot, and (c) providing a plurality of housings disposed to predetermined positions in said top of said container to facilitate attachment of said container to said cot, and (d) providing first means, including a conventional u-bolt assembly, for attaching said container to said cot, and (e) attaching said container to said cot using said first means therefore, and (f) storing said articles in said container.

* * * * *